United States Patent [19]

Lori

[11] 4,300,771

[45] Nov. 17, 1981

[54] BALL AND STRING SKILL TOY

[76] Inventor: Richard F. Lori, 88 Hall St., Mansfield, Mass. 02048

[21] Appl. No.: 74,167

[22] Filed: Sep. 10, 1979

[51] Int. Cl.[3] ..... A63B 67/22

[52] U.S. Cl. ..... 273/329

[58] Field of Search ..... 273/329, 331, 354

[56] References Cited

U.S. PATENT DOCUMENTS

| | | | |
|---|---|---|---|
| 834,077 | 10/1906 | Reiter | 273/329 |
| 2,399,636 | 5/1946 | Johnson | 273/329 |
| 4,160,549 | 7/1979 | Simpson | 273/354 |

FOREIGN PATENT DOCUMENTS

| | | | |
|---|---|---|---|
| 2321305 | 11/1973 | Fed. Rep. of Germany | 273/329 |
| 743136 | 1/1933 | France | 273/329 |
| 1152490 | 9/1957 | France | 273/329 |

*Primary Examiner*—Anton O. Oechsle

*Attorney, Agent, or Firm*—Wolf, Greenfield & Sacks

[57] ABSTRACT

A paddle toy comprised of a ball and string and having an elongated passage of length greater than the combined length of the ball and string. The string is attached at one end to a cross bar located in the upper portion of the paddle and is attached to a ball at the other end. The elongated passage formed within the paddle structure is shaped to permit the ball and string to swing through the paddle and in a preferred form has generally a key hole shape. In alternate embodiments, the invention is provided with means for varying the size of the elongated passage to regulate the skill required. The object of the toy is to impart a centrifugal force to the ball to keep it rotating about the cross bar and through the elongated passage in the paddle.

2 Claims, 6 Drawing Figures

BALL AND STRING SKILL TOY

BACKGROUND OF THE INVENTION

1. Field of the Invention

The invention relates to a paddle toy comprised of a paddle and a ball attached to one end of a string, the other end of which string is attached to the paddle, the paddle being provided with an elongated aperture permitting passage of the ball and string therethrough.

The invention relates to a paddle toy wherein the vertical length traversed by the elongated aperture is substantially equal to the length of the ball and string.

The present invention further relates to a paddle toy having an elongated aperture comprised of three sections, continuous and contiguous with one another, namely an upper aperture, a lower intermediate constriction aperture of the same or narrower width and yet a lower target aperture of sufficient size to permit passage of the ball therethrough.

The present invention further relates to a means for manually adjusting the size of the intermediate constriction aperture and means for manually altering the size and shape of the target aperture.

2. Description of the Prior Art

The prior art discloses a number of game paddle toys comprised of a ball and string attached to a paddle and target openings within the paddle structure for passage of the ball. For example, the references U.S. Pat. No. 883,860 and U.S. Pat. No. 964,473 disclose such a toy apparatus. However, the prior art as illustrated by the foregoing references discloses only singular apertures for a passage of the ball and string, whereas the present invention has enhanced the challenge of the toy by providing an aperture comprised of multiple channels continuous and contiguous to one another. Namely, in order to successfully pass the ball through a target aperture, the user of the present invention must be able to guide the string portion through a constriction aperture while simultaneously directing the ball through a target aperture by imparting a centrifugal force to the ball. Furthermore, the prior art paddle toys, for example, as that disclosed in U.S. Pat. No. 964,473, do not permit continuous revolution of the ball and string around a common support means axis, but rather only allow the user to make dis-jointed attempts to pass the ball through the target aperture. Continuous revolution of the string and ball around a common axis in the manner disclosed in the present invention permits the user to attempt to direct the ball through the target aperture by continually rotating the ball and string in complete revolution around a string support means common axis of a type not disclosed by the prior art.

Furthermore, alternate embodiments of the present invention are provided employing novel means for manually adjusting the constriction aperture width at the will of the user, as well as means for manually altering the size of the target aperture. Therefore, the difficulty and challenge of use of the present invention may be manually regulated by the individual user, thus, enhancing his interest in the toy. The prior art does not disclose means for manually adjusting the size of said apertures in the novel manner disclosed by applicant's invention.

SUMMARY OF THE INVENTION

The present invention is a toy comprised of a paddle having a handle and a ball and string attached to the paddle and a target means within the paddle structure having an elongated passage through which the ball and string may pass, wherein the vertical length of the elongated passage is greater than the combined length of the ball and string.

The string is attached on one end to a support means located in the upper portion of the paddle and a ball object is connected to the other end of the string. The elongated passage through which the ball and string passes is comprised of an upper aperture in contiguous continuous alignment with an intermediate constriction aperture, the constriction aperture being in continuous and contiguous alignment with a lower target aperture.

The width of the intermediate constriction aperture is equal to the width of the upper aperture or preferably is less than the width of said upper aperture. The size of the target aperture is at least sufficient to allow the ball to pass therethrough. The shape of the target aperture may be of circular or elongated form.

The handle is arranged with the target means intermediate the handle and the string support means. The string support means is preferably a cross bar located in the upper portion of the paddle and perpendicular to the length of the handle.

It is an object of the present invention to impart a centrifugal force to the ball in such a manner and direction as to permit the string to pass through the upper aperture and the narrower intermediate constriction aperture while simultaneously causing the ball to pass through the lower target aperture.

In an alternate embodiment of the invention, a support frame comprised of a pair of vertical arms is provided instead of a paddle. A cross bar string support means is connected to the upper end of the vertical arms and the ball and string suspended from the cross bar. An elongated chamber through which the ball and string passes is comprised of an upper aperture, and intermediate constriction aperture of narrower width and a lower target aperture. The combined length of the string and ball from the lower axial edge of the cross bar is less than the total length of the elongated passage. A frame is provided with a horizontally adjustable member so that the intermediate constriction aperture can be manually narrowed or widened. The frame is positioned between the vertical arms near the central portion of said arm or towards the lower end of the arms. The target aperture is pre-formed in a plate member which is attached to the frame by screws or other fastening means. The user of the toy may readily remove the plate and replace it with one having a slightly wider or narrower target aperture, thus increasing or decreasing the difficulty of passing the ball through the target aperture.

The object of the alternate embodiment of the invention is to impart a centrifugal force to the ball, preferably while the toy apparatus is placed upright on a flat surface, the centrifugal force being directed to the ball in such direction that the string passes through the upper aperture and the constriction aperture and the ball simultaneously passes through the lower target aperture.

DESCRIPTION OF THE PREFERRED EMBODIMENT

Figure 1:
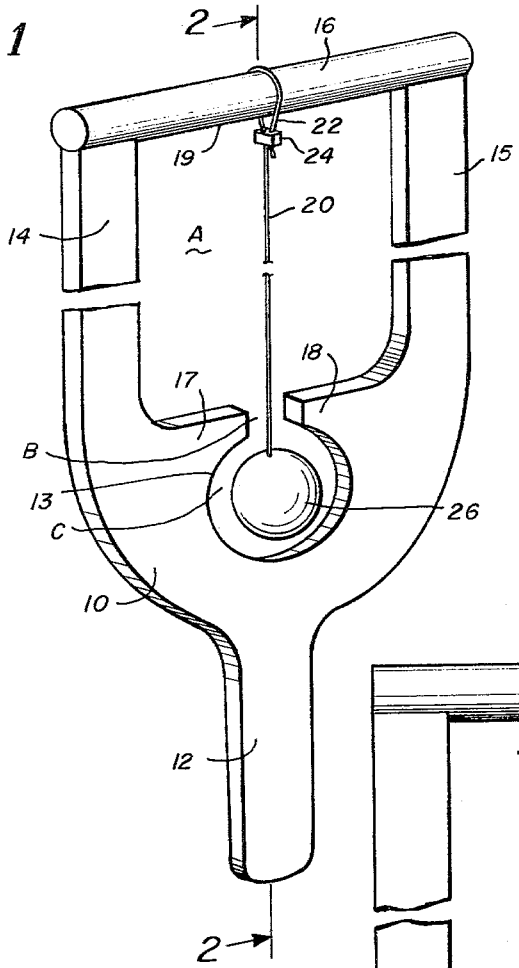
FIG. 1 is an isometric illustration of the paddle toy embodiment of the invention.

A preferred embodiment of the paddle toy of the invention is shown illustrated in FIG. 1. The paddle toy illustrated in FIG. 1 is comprised of a ball 26, a string 20 and a paddle 10. The paddle is comprised of a string support means 16, a target means defined by aperture C near the center of the paddle and a handle 12 arranged with the target means defined by aperture C which is located intermediate the handle 12 and the string support means 16. The string support means is preferably a cross bar located in the upper portion of the paddle and arranged in an alignment perpendicular to the length of the handle. The paddle may be constructed typically of wood or high density plastic, such as high density polyethylene or polypropylene plastic material. The ball is preferably made of a hard rubber material. The paddle is further comprised of upper arms 14 and 15 to which string support means cross bar 16 is attached. A string 20 is hung loosely in perpendicular arrangement from a cross bar 16 and a ball 26 attached to the opposite end of said string. A fastening means 24 is provided to loosely connect the string to cross bar 16 as depicted in FIG. 1. The upper arms 14 and 15, cross bar support means 16 and jutting members 17 and 18 define an upper aperture A through which the upper portion of the string passes upon movement of the ball and string through the target aperture C. The aperture C may be a circular or elongated aperture of size somewhat greater than the size of ball 26. The aperture C is defined by the lower portion of vertical arms 14 and 15 of the paddle and jutting members 17 and 18 provided at the lower end of the arms 14 and 15 as illustrated in FIG. 1. The jutting members 17 and 18 at the lower end of arms 14 and 15 also form a constriction aperture B. The aperture B is contiguous and continuous with apertures A and C and is located intermediate apertures A and C. The constriction aperture B is of narrower diameter than either aperture A or C. The aperture A may be of the same width as aperture B but preferably is of greater width than aperture B. The apertures A, B and C form a continuous elongated chamber through which the ball and string may be swung from support means 16 upon imparting a centrifugal force to the ball. A feature of the invention is that the combined length of the string and ball from the lower axial edge 19 of cross bar 16 is less than the vertical length of the continuous elongated passage comprised of apertures A, B and C.

Figure 2:
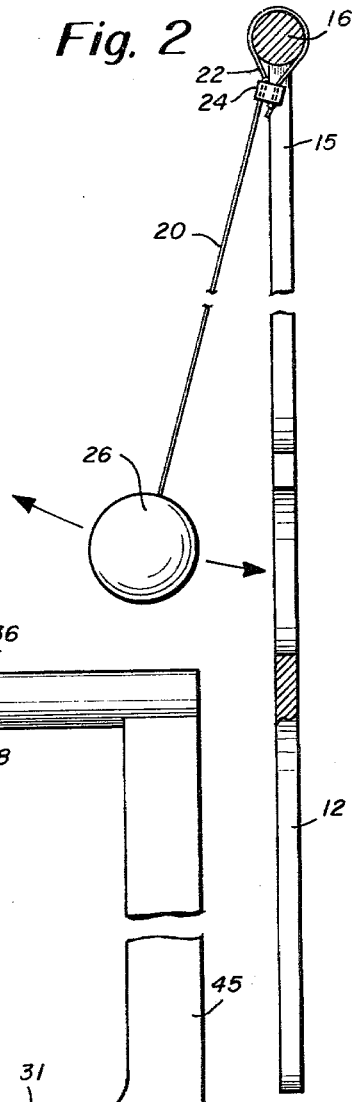
FIG. 2 is a sectional view taken along lines 2—2 of FIG. 1 illustrating the relationship between ball and paddle as centrifugal force is imparted to the ball.

In operation when the handle 12 of the paddle is flicked by wrist motion, a centrifugal force is imparted and the ball swings freely from cross bar 16 as illustrated in FIG. 2. The object for the user of the toy is to attempt to swing the ball 26 through the target aperture C and simultaneously to direct the lower portion of the string 20 through the constriction aperture B as best illustrated in FIG. 1. As greater centrifugal force is imparted to the ball, the ball may be easily caused to make complete revolutions around cross bar 16 and attainment of the objection of the toy, namely, to pass the ball through target aperture C thereby becomes increasingly more challenging.

Figure 3:
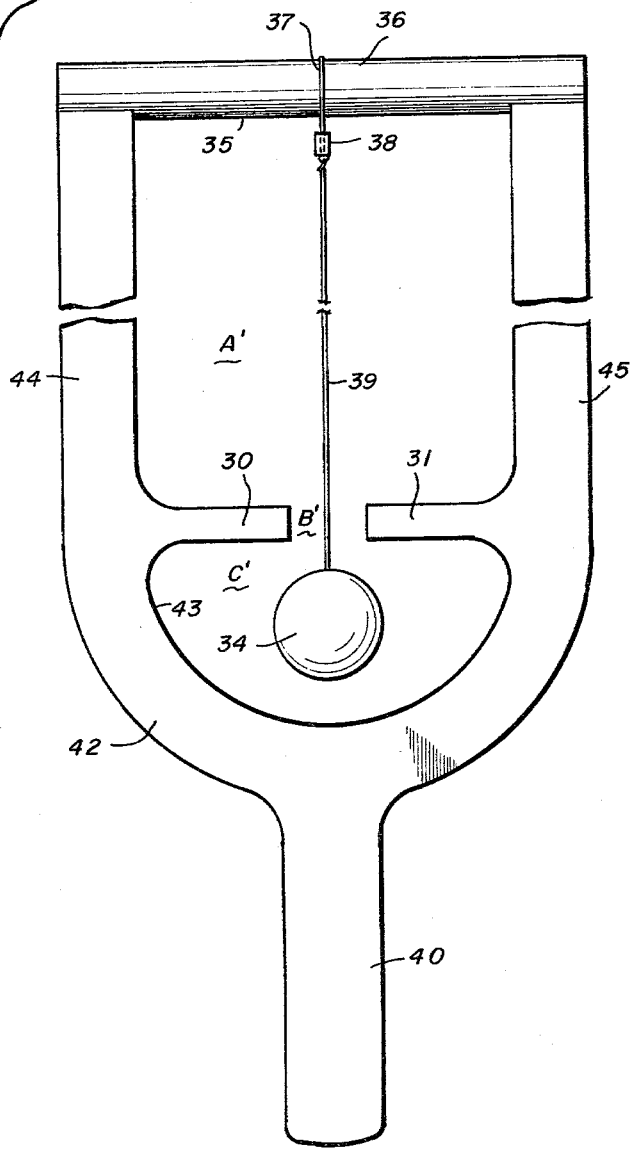
FIG. 3 is an elevation view of an alternate paddle toy embodiment of the invention illustrative of the use of an elongated target aperture.

An alternate embodiment of the invention employing a larger target aperture C′ is illustrated in FIG. 3. The cross bar string support means 36, upper arms 44 and 45, jutting members 30 and 31 and handle 40 illustrated in alternate embodiment FIG. 3 are analogous to the members 16, 14, 15, 17 and 18 and 12, respectively, in FIG. 1. Similarly, a string 39 is hung loosely from cross bar 36 in perpendicular arrangement to the cross bar. An upper aperture A′ defined by cross bar 36, upper arms 44 and 45 and jutting members 30 and 31, is formed analogous to the upper aperture A of FIG. 1 and a constriction aperture B′ defined by jutting members 30 and 31 is formed analogous to constriction aperture B of FIG. 1. As illustrated in the FIG. 3, the jutting members 30 and 31 and the lower portion of arms 44 and 45 form an elongated target aperture C′ which may be laterally and/or vertically of greater width than the circular aperture C depicted in FIG. 1. The effect of the larger target aperture C′ permits easier passage of the ball 34 through said target aperture upon imparting a centrifugal force to the ball and, therefore, permitting easier use of the toy by younger children. Also, a feature of the embodiment illustrated in FIG. 3 is that the combined length of the string and ball from the lower axial edge 35 of cross bar 36 is less than the total vertical length traversed by the elongated passage comprised of apertures A′, B′ and C′.

Figure 4:
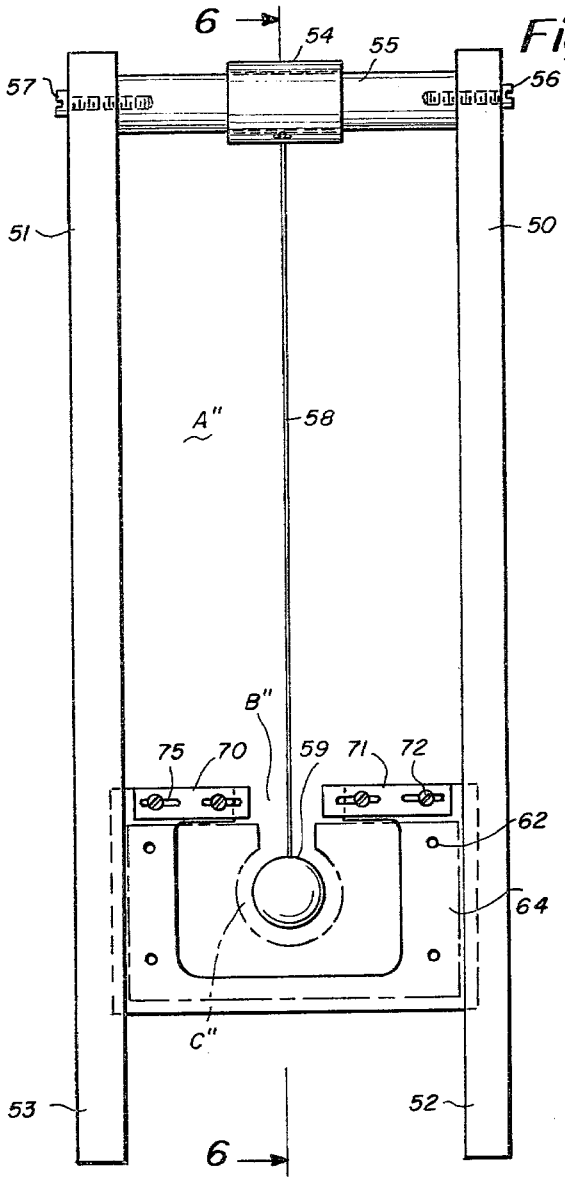
FIG. 4 is an alternate embodiment employing an upright adjustable frame structure for adaptation of the concept of the invention to use on a flat surface.
Figure 6:
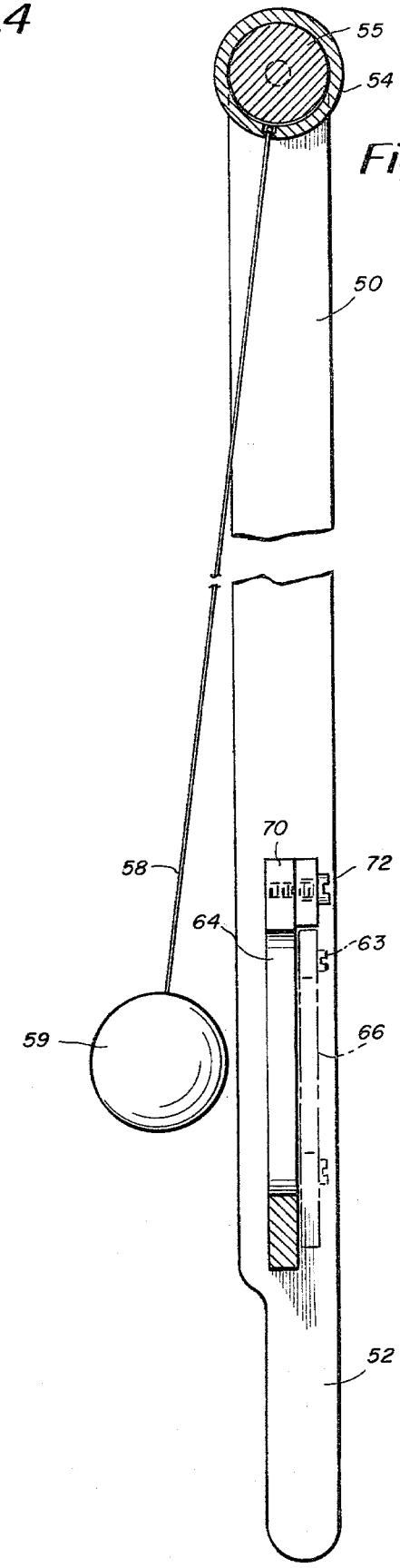
FIG. 6 is a sectional view taken through line 6—6 of FIG. 4 illustrating the attachment of the target plate of the adjustable frame.
Figure 5:
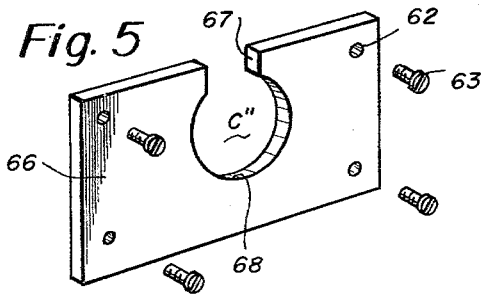
FIG. 5 is an isometric illustration of a plate having a pre-formed target aperture therein.

Another embodiment of the present invention is illustrated in FIGS. 4, 5 and 6. This embodiment of the invention is a target toy having similar features as the earlier embodiments but is designed to be held upright on a flat surface rather than a freely-held paddle. The embodiment depicted in FIG. 4 is defined by a pair of vertically aligned straight arms 50 and 51 which are laterally displaced from each other. Lower portions 52, 53 of arms 50, 51, respectively are rounded as shown in FIG. 6 in order that the user may more easily manipulate the toy during play. A string support means cross bar 55 is attached to the upper end of the arms 50 and 51 by rivets or screws 56 and 57, respectively. The arms 50 and 51 and cross bar 55 may typically be of wooden construction or of high density plastic such as high density polyethylene or polypropylene plastic material.

A coupling member 54 is loosely fitted around the central portion of the cross bar 55 permitting free rotation of the coupling member around the circumference of the cross bar. One end of a string 58 is attached to the coupling member and a ball 59 is affixed to the other end of the string. A frame 64 is positioned between arms 50 and 51 within grooves provided along the inner surface of said arms. The frame may be glued or fastened to the arms at a fixed distance along the arms length or may be positioned within grooves or slots (not shown) which are provided within the inner surface of the arms permitting variable positioning of the frame along the vertical length of the arms. Horizontally adjustable members 70 and 71 are fastened to the top of the frame 64 on both ends by screws 72 fitted into slot 75 provided within members 70 and 71. The slots provided in the members 70 and 71 permit easy horizontal adjustment of said members be merely loosening the screw bolt 72 and sliding members either to the right or left. Horizontal adjustment of the members 70 and 71 in effect permits the user to alter the size of the constriction aperture B″ formed by the space between the members 70 and 71.

A plate 66 of wooden plastic or metal construction having a target aperture C″ preformed therein is fastened to the back sides of frame 64 by screw 63 placed into receiving holes 62 as best illustrated in FIGS. 5 and 6. As in the foregoing embodiment, the target aperture C″ must be of minimum width which is at least somewhat greater than the ball diameter to permit passage of the ball through the target aperture C″. Plate 66 having target aperture C″ of larger dimension, for example, in the shape and size of elongated target aperture C as earlier described with reference to FIG. 3, is within the scope of the present invention. In fact, the user of the toy embodiment illustrated in FIG. 4 may be supplied with a number of different plates 66 each having a different size target aperture C″. The user may readily change the plate attached to frame 66 my merely removing the screw 63 and lifting out the existing plate and replacing it with one of a number of different plates provided having a different size aperture C″ therein. Thus, the user of the embodiment depicted in FIG. 4 may enhance the challenge of the toy game by sliding adjustable members 70 and 71 inward thereby narrowing the constriction aperture B″, and/or by employing plate 66 having a narrower target aperture C″.

In operation, the user of the toy illustrated in FIG. 4 may preferably place the toy structure upright on a flat surface and impart a centrifugal force to the ball by a simple flick of the wrist or else by hitting the ball 59 directly. Depending on the force imparted to the ball, the ball may be caused to swing only slightly or may be caused to swing greatly making a complete revolution around the cross bar 55 and passage of the ball through the target aperture C″ thereby becomes more challenging. The combined length of the string and ball from the lower axial edge of coupling member 54 is less than the total vertical length of the elongated passage comprised of upper aperture A″, constriction aperture B″ and the target aperture C″.

Although the present invention has been described with respect to a ball and string combination, it should be understood that the invention is not intended to be limited to such a combination, since the invention is equally applicable to use of a irregularly-shaped weighted objects preferably of hard rubber construction instead of a ball. Also, the invention is not intended to be limited to the use of a string, since a wire or rope cable can be equally effective.

What is claimed is:

1. A toy apparatus comprising:

a structure having a pair of longitudinally coextensive vertical arms forming an elongated passage and having a portion forming a string support means at one end of said passage, said structure arranged with said elongated passage intermediate the vertical arms and the string support means, the lower portions of said arms being perpendicular to said string support means, said string support means interconnecting said longitudinally coextensive vertical arms remote from said lower arm portions, a sleeve coupling member rotably mounted around said string support means, a string attached at one end to the coupling member, and at the other end to a ball, the combined length of the string and ball from the edge of said coupling member being less than the length of said elongated passage, a frame having an opening including an upper portion and a lower portion, said frame positioned between said vertical arms and connecting said vertical arms at a point along the arms such that the distance between said coupling member and the center of the lower portion of said opening of the frame is substantially equal to the length of the string, a rigid plate having a hollow target aperture, the target aperture being of a diameter greater than the diameter of the ball, and said plate being fastened to said frame by fastening means, and said elongated passage thereby comprised of an upper aperture defined by said string support means, said longitudinally extensive vertical arms and the upper portion of said frame opening, and an intermediate constriction defined by the upper portion of said frame aperture contiguous with and located below said upper aperture, and said target aperture contiguous with and located below the constriction aperture, said constriction aperture having a width less than the width of the upper aperture and formed by at least one constricting member attached substantially perpendicularly to each one of said longitudinally coextensive vertical arms and extending partially into the elongated passage, so that upon imparting a centrifugal force to the ball, the ball and string may rotate around the string support means and through said elongated passage with a portion of the string passing through the constriction aperture and with the ball passing through said target aperture.

2. A toy apparatus as in claim 1 wherein said constricting members comprise a pair of horizontally adjustable sliding members affixed to the top of the frame, one adjustable sliding member being positioned on the frame close to one of the longitudinally extending arms and the other adjustable member positioned on the frame close to the other longitudinally extending arm such that a constriction aperture is formed and defined by the inner edges of said adjustable members, the width of said constriction aperture being manually regulated by horizontally adjusting the sliding members, and wherein the frame is slidably positioned with the inner edges of the longitudinally extending arms so that the frame may be manually adjusted in the longitudinally extending direction.

* * * * *